United States Patent [19]

Rettkowski

[11] 4,247,147

[45] Jan. 27, 1981

[54] RETAINER CLIP FOR CUTTER BITS

[75] Inventor: Gary Rettkowski, Mountaintop, Pa.

[73] Assignee: Sandvik Aktiebolag, Sandviken, Sweden

[21] Appl. No.: 96,331

[22] Filed: Nov. 21, 1979

[51] Int. Cl.[3] ..... E21C 25/46; E21C 35/18

[52] U.S. Cl. ..... 299/10; 37/142 A; 175/354; 285/321; 299/86; 299/92; 403/326; 403/DIG. 7; 411/353; 411/517

[58] Field of Search..... 299/86, 92, 10; 85/8.8; 37/142 A; 175/413, 354; 279/19.7, 80; 285/321; 403/326, DIG. 7

[56] References Cited

U.S. PATENT DOCUMENTS

| | | | |
|---|---|---|---|
| 3,512,838 | 5/1970 | Kniff | 299/86 |
| 3,752,515 | 8/1973 | Oaks et al. | 299/86 X |
| 3,767,266 | 10/1973 | Krekeler | 299/92 |
| 3,841,708 | 10/1974 | Kniff et al. | 299/86 |

*Primary Examiner*—Ernest R. Purser

*Attorney, Agent, or Firm*—Burns, Doane, Swecker & Mathis

[57] ABSTRACT

A retainer clip for tool bits comprises an annular strip having circumferentially spaced ends defining a gap therebetween. A pair of proximate projections and at least one remote projection project outwardly from the strip. The proximate projections are located on opposite sides of the gap. The proximate projections include positively oriented front surfaces, and the remote projection includes a non-positively oriented front surface disposed longitudinally rearwardly relative to forwardmost portions of the front surfaces of the proximate projections. Upon forward displacement of the clip within the hole of a holder, contact occurs between the proximate projections and a wall of a retaining groove of the holder to produce radial shifting of the gap of the clip toward the axis of the bit. Removal of the bit from the hole is possible only by shearing the remote projection.

27 Claims, 15 Drawing Figures

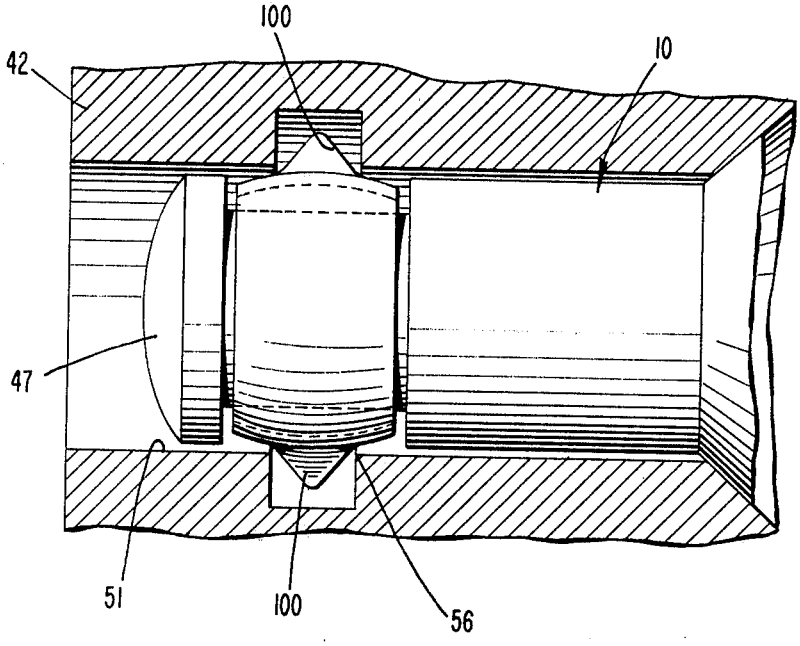
Fig. 8
PRIOR ART
Fig. 13
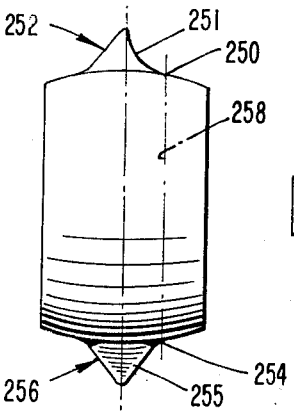
Fig. 9
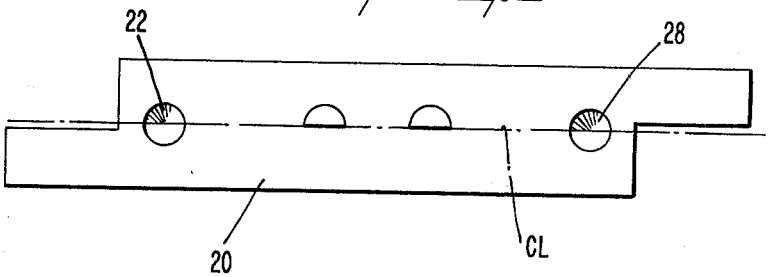
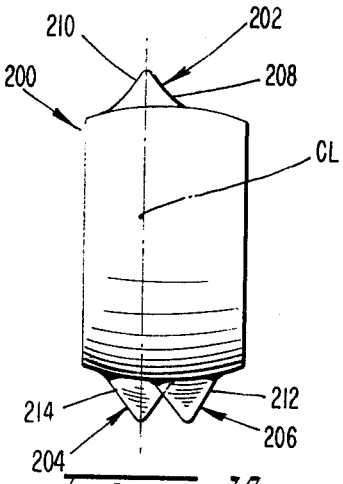
Fig. 10
Fig. 11
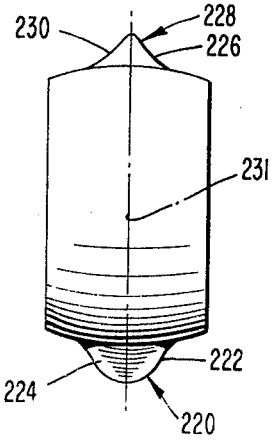
Fig. 12
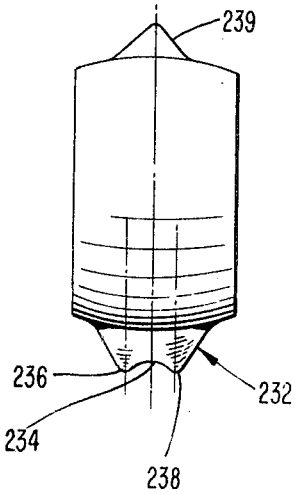

RETAINER CLIP FOR CUTTER BITS

BACKGROUND AND OBJECTS OF THE INVENTION

The present invention relates to retainer elements for tools and, in particular, to a split retainer clip detachably mounted on a tool shank for rotatably mounting the tool in a holder.

It has heretofore been proposed to employ split retainer clips for securing tools or bits to holders, as evidenced for example by the disclosures of U.S. Pat. Nos. 3,499,685 issued to Kniff on Mar. 10, 1970 and 3,752,515 issued to Oaks on Aug. 14, 1973. Such retainer clips may be employed in connection with pick-type mining bits for securing the bits to a holder while permitting the bits to freely rotate.

The retainer clip comprises a steel ring which is axially split to form a circumferential gap, enabling the ring to be resiliently compressed. Protuberances or projections are provided on the outer surface of the ring which have inclined forward and rearward surfaces. Such surfaces form cam surfaces which radially compress the ring as it is pushed rearwardly into a receiver hole in a bit holder. When the projections become aligned with an annular retaining groove of the holder, the ring snaps outwardly into the groove to secure the bit to the holder. To remove the bit, forwardly directed forces are applied by a suitable tool to again cause the projections to compress the ring, whereupon the bit is able to be withdrawn from the hole of the holder.

It has been found that when used to secure mining bits in high speed rotary drums, the clips may not be able to withstand forces tending to remove the bit from the holder. In this regard, the typical high speeds of the rotary drum generate substantial centrifugal aforces on the bits, tending to throw the bits from the holder. Also, when the drums are backed-off from the formation being cut, strong frictional or drag forces may be generated by contact of the bits with the formation which tend to pull the bits from the holder.

Another problem which has been experienced involves jamming of the bits within the holder. In this regard, in response to the afore-mentioned centrifugal and frictional forces, a rear abutment part of the bit shank abuts against the clip as the latter attempts to resist the forces. In some instances the abutment part partially wedges itself into the rear end of the clip, causing the ends of the clip, i.e., the spaced gap-forming edges, to become jammed between the outer wall of the abutment part and the inner wall of the hole of the holder. As a result, it becomes extremely difficult, if not impossible, to remove the bit for replacement at the job site.

It is, therefore, an object of the present invention to minimize or obviate problems of that sort.

Another object is to prevent the clip from becoming jammed between the bit and the hole of the holder.

An additional object is to maximize the loads which the clip can sustain before allowing removal of the bit.

BRIEF SUMMARY OF A PREFERRED EMBODIMENT OF THE INVENTION

These objects are achieved by a retainer clip to be carried by a cutter bit, the bit being of the type having a cutter head, a rearward shank, and a recess on the shank. The clip comprises an annular strip disposed in said recess and having circumferentially spaced ends defining a gap therebetween. A pair of proximate projections and at least one remote projection project outwardly from the strip. The proximate projections are located on opposite sides of said gap, the remote projection being located remotely therefrom. The proximate and remote projections including positively oriented rear surfaces for camming the strip to a radially contracted condition in response to being inserted into a hole of a holder. The contracted strip is resilient to spring radially outwardly in response to the projections becoming aligned with a retaining groove in the hole. The proximate projections include positively oriented front surfaces. The remote projection includes a front surface whose forwardmost portion is disposed longitudinally rearwardly relative to forwardmost portions of the front surfaces of the proximate projections such that forward displacement of the shank within the hole produces contact between the front surfaces of the proximate projections and a wall of the retaining groove to produce radial non-centering movement of the clip whereby the gap approaches the axis of the shank.

THE DRAWING

Other objects and advantages of the invention will become apparent from the following detailed description of a preferred embodiment thereof in connection with the accompanying drawings in which like numerals designate like elements, and in which:

FIG. 8 is a view similar to FIG. 5 of a prior art retainer clip;

FIG. 9 is a view similar to FIG. 2 depicting an alternate embodiment of the retainer clip; and FIGS. 10, 11, 12, and 13 are side views of alternate embodiments of the clip.

DETAILED DESCRIPTION OF PREFERRED EMBODIMENTS OF THE INVENTION

Figure 1:
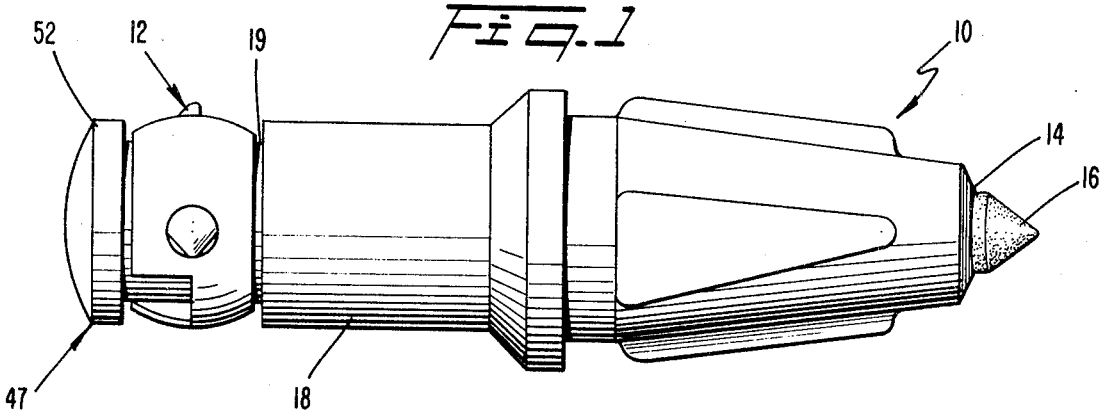
FIG. 1 is a side view of a mining cutting bit carrying a retainer clip in accordance with the present invention.

In FIG. 1 there is depicted a conventional mining bit 10 carrying a retainer clip 12 according to the present invention. The bit 10 includes a head portion 14 carrying a hard pointed insert 16, and a rearwardly extending cylindrical shank 18. The shank 18 includes an annular recess 19 within which the retainer clip 12 is mounted. The inner diameter of the clip is greater than the diameter of the base 21 of the recess 19 (FIG. 5), to provide radial play for the clip 12. Moreover, the longitudinal length of the recess is greater than that of the clip 12 to provide limited axial play for the clip 12.

Figure 2:
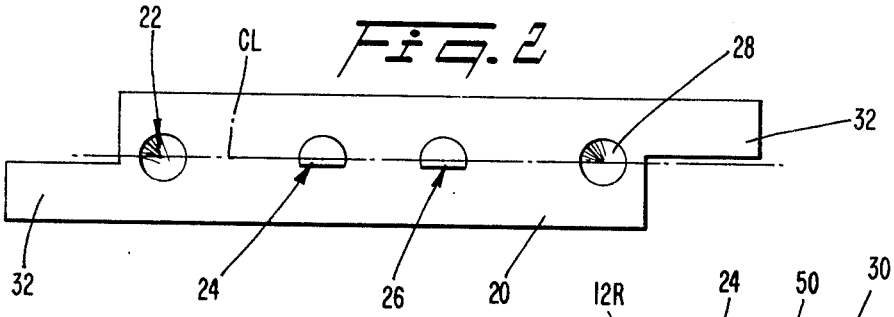
FIG. 2 is a plan view of the retainer clip depicted in a flattened state.
Figure 2A:
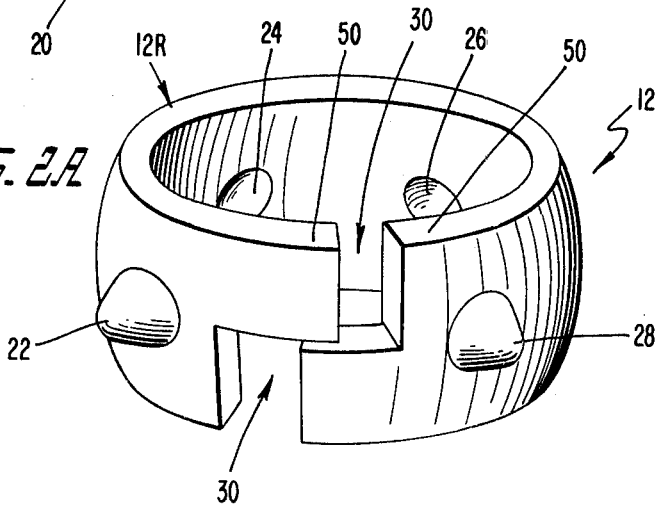
FIG. 2A is a perspective view of the clip in its normal annular configuration.

The retainer clip 12, depicted in FIG. 2 in a flattened condition for the sake of clarity, comprises a steel strip 20 carrying a plurality of outwardly projecting projections 22, 24, 26, 28. In the normal, annular configuration of the clip, illustrated in FIGS. 2A and 3, the projections are circumferentially spaced and generally radially extending.

The ends of the strip are split, preferably by circumferentially overlapping extensions which form a circumferential gap 30 of the clip, in conventional fashion.

Figure 3:
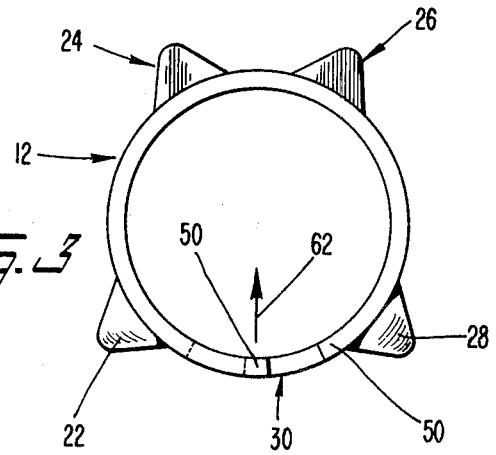
FIG. 3 is a front end view of the retainer clip.

As viewed clearly in FIG. 3, two of the projections 22, 28 are located proximate to the gap 30, and the remaining projections 24, 26 are located remote from the gap, preferably generally diametrically opposite the proximate projections 22, 28. The proximate projections 22, 28 are spaced equidistantly from opposite ends of the gap 30, as are the remote projections 24, 26.

The proximate projections 22, 28 are configured in conventional fashion so as to present front and rear inclined surfaces 34, 36. The front surface is inclined in a direction having radially outward and longitudinally rearward components, and the rear surface 36 is inclined in a direction having radially outward and longitudinally forward components. In this regard, the proximate projections 22, 28 are preferably of conical configuration with generally blunt outer tips.

Figure 5:
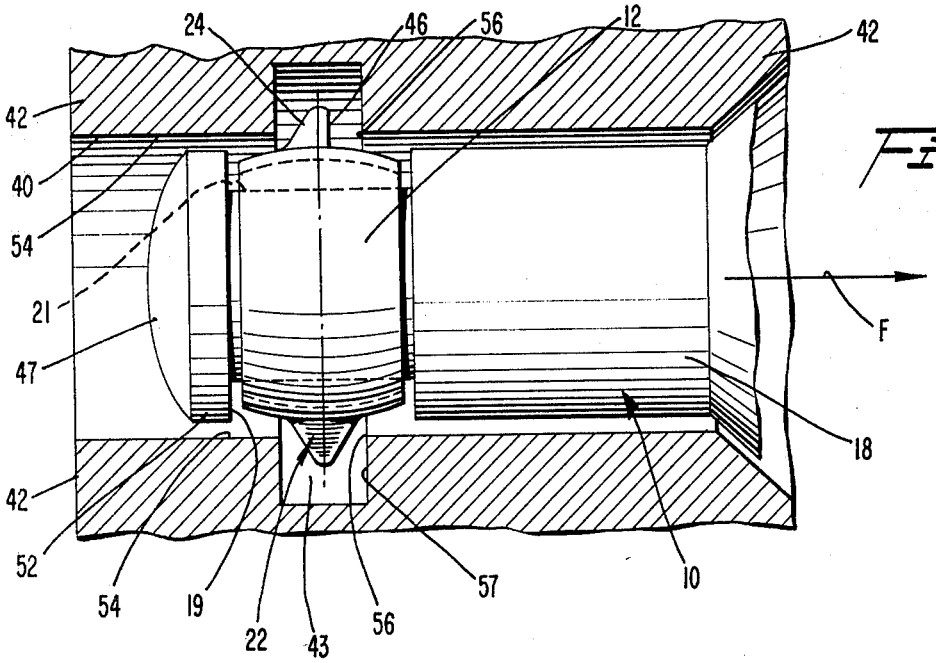
FIG. 5 is a longitudinal sectional view through a holder of a mining cutter head, depicting the bit and retainer clip in an at-rest condition.

As is conventional, the inclined rear surfaces of the proximate projections function to cam the retainer clip radially inwardly to a smaller diameter (i.e., converge the ends of the strip) when the bit is inserted rearwardly into a hole 40 of a bit holder 42 (FIG. 5). This radial contraction occurs until the projections are radially aligned with an annular retaining groove 43 of the holer 40, whereupon the clip springs outwardly and the projections enter the groove 43.

As defined herein, the front or rear surface of a projection may be considered to have a "positive" orientation or inclination if the longitudinal component of that direction of the surface having a radially outward component, is directed away from the direction (front or rear) in which the surface generally faces. Thus, the front and rear surfaces 34, 36 of the proximate projections 22, 28 are each "positively" oriented because the direction thereof having a radial outward component (as compared to a radial inward component) has a longitudinal component directed away from the direction in which the surface generally faces. A "negative" orientation occurs when the afore-described longitudinal component of the surface is directed toward the direction (front or rear) in which the surface generally faces.

Figure 7:
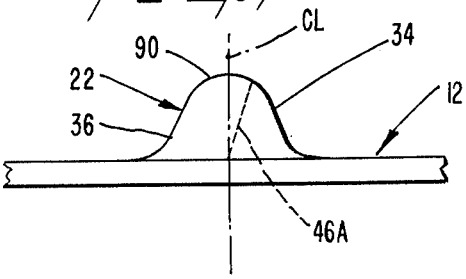
FIG. 7 is a side view of a remote projection of the retainer clip, which remote projection is located remote from the axial split of the clip.
Figure 7A:
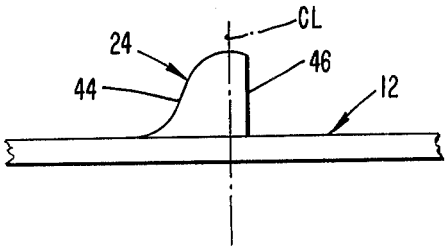
FIG. 7A is a view similar to FIG. 7 of a proximate projection of the retainer clip, which proximate projection is located proximate to the axial split of the clip.

The remote projections 24, 26 include positively oriented rear surfaces 44 similar to those 36 of the proximate projections 22, 28 to perform the afore-described camming action when the bit is installed. However, in accordance with the present invention, the front surfaces 46 of the remote projections are oriented non-positively. Preferably, such front surfaces 46 of the remote projections extend radially (FIG. 7A) (or they may be negatively oriented by virtue of having radially outward and longitudinally forward components as depicted by a broken line 46A in FIG. 7).

Figure 4:
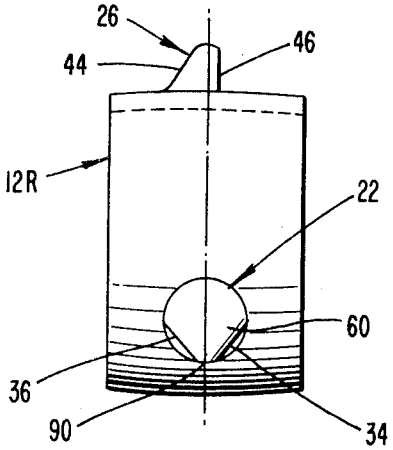
FIG. 4 is a side view of the retainer clip.

The non-positive orientation can be achieved by, in effect, removing less than half (FIG. 7A) or half (FIG. 9) of the front side of a conventional conical projection. Of course, in practice, the proximate projection would be initially formed in the final shape, no "removal" of a projection portion being involved. A comparison between a proximate projection 22 and a remote projection 24 can be made from FIGS. 7A and 7B, wherein the relationships between the front and rear projection surfaces and the projection centerplane CL is depicted, the centerplane CL being defined by a plane perpendicular to the tooth axis and bisecting the proximate projections 22, 28. Thus, the forwardmost part of the front surface of each remote projection 24, 26 is located longitudinally rearwardly relative to the forwardmost part 60 of the front surface of the proximate projections 22, 28, as is evident from FIG. 4.

The advantages of the present invention occur during operation of the installed bit. Forwardly directed forces F acting upon the bit, as the result of afore-described centrifugal or drag forces for example, cause the bit to be displaced forwardly. As a result, a rear abutment portion 47 of the shank abuts against a rear axial end 12R of the clip (FIG. 4), urging the latter forwardly. In previous instances, such action could result in a dislodgement of the bit from the holder 42, or a jamming of the end edges 50 (FIG. 2A) at the rear axial end 12R of the clip within a clearance 51 formed between the outer surface 52 of the rear portion 47 of the bit shank and the inner surface 54 of the hole 40 of the holder 42 (FIG. 5). Both possibilities are greatly minimized by the present invention.

In this regard, it will be appreciated that as the bit 10, and thus the retainer clip 12, is urged forwardly, initial projection contact against an inner edge 56 of a front wall 57 of the retaining groove 43 occurs at the front surfaces 34 of only the proximate projections 22, 28, i.e., not at the remote projections 24, 26. Thus, there occurs a camming action whereby the retainer clip is displaced relative to the bit shank in a non-centering direction 62 (FIG. 3) radially away from the portions of the groove edge 56 being contacted by the proximate projections. It will thus be appreciated that the end edges 50 of the rear end of the clip 12 are displaced toward the axis of the hole 40, and away from the clearance 51, thereby minimizing chances for those end edges 50 to become jammed therein. As forward displacement of the bit continues, the strip is pushed toward and against the inner wall 54 of the hole 40, whereafter the gap 30 is closed and the diameter of the clip is reduced. Thus, the end edges 50 of the clip are displaced yet further toward the bit axis and away from the clearance 51.

During the use of previously proposed clips (see FIG. 8), projection contact with the groove edge 56 occurs simultaneously at the positively oriented front surfaces of the proximate and remote projections 100, whereby radial forces acting on the clip are equalized and the net effect is a centering of the clip relative to the bit axis, contrary to the anti-centering action induced in accordance with the present invention.

Figure 6:
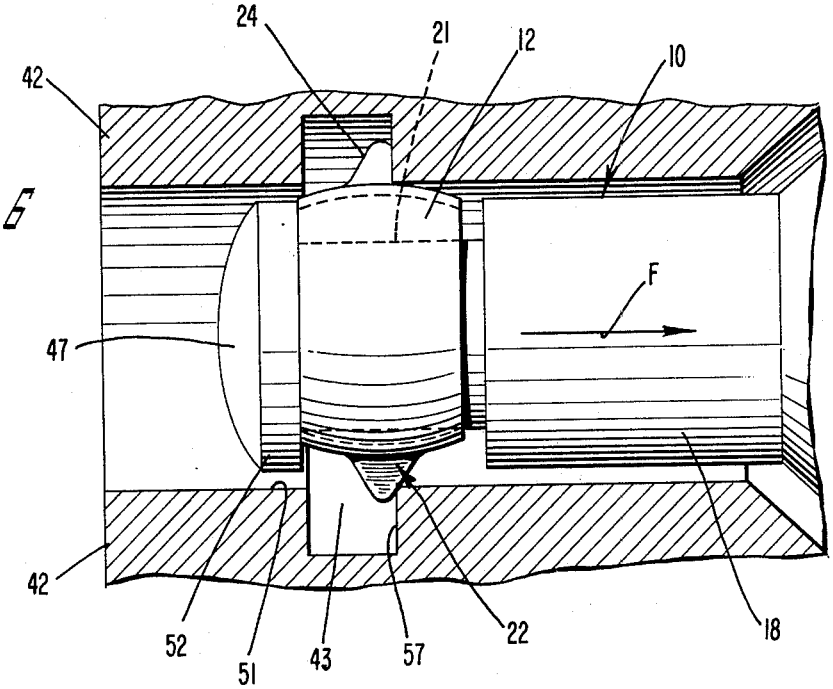
FIG. 6 is a view similar to FIG. 5 depicting the bit as it is acted upon by forwardly directed forces.

As the bit is displaced further forwardly, the front surface 46 of the remote projections 24, 26 contact the front wall 57 of the retaining groove 43 to effectively resist further forward displacement of the bit (FIG. 6). Since such front surfaces 46 are not positively oriented, no camming action occurs which would tend to push the remote projections from the retaining groove, as can occur in previously proposed devices. Actually, further forward displacement of the bit beyond the FIG. 6 position would be possible only if the remote projections 24, 26 of the present invention are sheared-off at their bases, and the proximate projections are fully compressed smaller than the diameter of the hole 40. In this regard, it will be appreciated that by orienting the front surfaces 46 of the remote projections 24, 26 longitudinally forwardly of the apex or center 90 of the proximate projections 22, 28, i.e., forwardly of the centerplane CL (see FIG. 4), the edge 56 of the retaining groove cannot contact the apex 90 of the proximate projections and thereby fully compress such proximate projections unless the remote projections shear.

When the forwardly directed forces on the bit are relieved, the spring pressure generated by the compressed clip acts through the proximate projections 22, 28 to snap the tool back to its initial position.

To eject the tool, a forward force is applied to the tool until the remote projections 24, 26 shear and the proximate projections 22, 28 are compressed smaller than the diameter of the hole 40.

In accordance with the present invention, at least two proximate projections and at least one remote projection are required. That is, the two earlier described remote projections 24, 26 could be replaced by a single remote projection preferably disposed diametrically opposite the gap 30.

More than the illustrated number of four projections can be provided, if desired, as by inserting additional projections between the remote and proximate projections 22–24 and 26–28.

It will be appreciated that configurations of the projections other than those illustrated and disclosed herein are possible. For example, the front and rear inclined surfaces 34, 36, 44, 46 can be flat (while still inclined), rather than curved (as is the case with a conical projection or partially conical projection); this can be achieved by a pyramidal or diamond-shaped projection for example. Each proximate projection need not be symmetrical about the centerplane CL or about a longitudinal plane; rather one side surface may have a different degree of inclination relative to the other side surface of a given projection, or a projection of elliptical cross-section can be utilized. The projections need not be rounded or pointed at their outer tips, but rather can be truncated; or a slight recess can be formed in a truncated tip, forming adjacent peaks on a given projection.

Another embodiment of the present invention is illustrated in FIG. 10. A clip 200 contains two remote projections 202, and two pairs of proximate projections 204, 206, only one pair of projections being depicted. The remote projections 202 have positively oriented front and rear surfaces 208, 210. One of the proximate projections 206 is arranged such that its forward surface 212 is disposed longitudinally forwardly of the forward surface 208 of the remote projections 202. The other proximate projection 204 is arranged such that its rear surface 214 is longitudinally co-extensive with the rear surfaces 210 of the proximate projections, i.e, the surfaces 210, 214 are symmetrical relative to the longitudinal axis of the clip. The other pair of proximate projections (not shown) are arranged identically to those 204, 206 depicted.

It will be appreciated that when the bit is in a mounted condition within a hole of the holder, forwardly directed forces acting upon the bit produce the anti-centering effect described earlier, since the front surfaces 212 of the two forward proximate projections 206 engage the front wall of the retainer grooves before the remote projections engage such wall. The fact that the front surfaces 208 of the remote projections 202 are positively oriented, eliminates the need to shear such projections 202 in order to replace a worn bit. Moreover, the presence of rear surfaces 214 on the rearward pair of proximate projections, which are longitudinally co-extensive with those 210 of the remote projections 202, assures that while the bit is being installed within the holder hole, the radial compressive forces acting upon the clip are equalized so that the clip does not become skewed and jammed within the hole. If desired, the front surfaces 208 of the remote projections could be non-positively oriented.

Other configurations of the proximate projections for achieving the same results as discussed in connection with FIG. 10 are illustrated in FIGS. 11 and 12. In the FIG. 11 embodiment there are provided two proximate projections 220 (only one depicted), each having front and rear surfaces 222, 224, and two remote projections 228 (only one depicted) each having front and rear surfaces 226, 230. The front surface 222 of each proximate projection is located longitudinally forwardly of front surfaces 226 of each remote projection 228, and the rear surface 224 of each proximate projection is located longitudinally rearwardly relative to rear surface 230 of each remote projection. By arranging the rear surface 224 of each proximate projection to extend rearwardly of the rear surface 230 of each remote projection 228, the proximate projections will engage the holder hole before the remote projections when inserting a bit into the holder. However, this occurrence is acceptable as long as the proximate projections, not the remote projections, are the first to engage, because the result is merely that the gap of the clip will be first collapsed and thereafter the remote projections will engage to equalize the radial forces. The advantage to the configuration of FIG. 11 is that the remote and proximate projections are symmetrical about a transverse plane 231 which bisects all projections, so that there is no need to be concerned about which end of the clip constitutes the front end or the rear end. That is the clip need not be specifically oriented one way or the other on the bit.

In FIG. 12, proximate projections 232 (only one depicted) similar to that of FIG. 11 is provided except that a depression 234 is formed therein so as to define a pair of peaks 236, 238. The remote projections 239 are identical to those of FIG. 11.

In FIG. 13 an embodiment of the invention is disclosed in which the forwardmost ends 250 of the front surfaces 251 of each remote projection 252 and the forwardmost ends 254 of the front surface 255 of each proximate projection 256 lie on a common plane 258 extending perpendicular to the longitudinal axis of the shank. However, the front surface 251 of the remote projection is of concave configuration in side view, whereby the proximate projection contacts the edge 56 before the remote projections.

It should be noted that in the event that the longitudinal dimension of a projection according to the present invention is too long to fit within a standard retaining groove 43, the projection can be angled relative to the longitudinal direction so that its direction from the front surface to the rear surface has longitudinal and circumferential components. In this manner, the actual longitudinal component can be made small enough to fit within the retaining groove.

In accordance with the present invention, the problem of jamming of the clip is eliminated, because the clip is shifted radially to a non-centered position wherein the gap of the clip approaches the bit axis. Thus, the portions of the clip which are prone to jamming in the clearance between the bit and hole are actually displaced considerably away from such clearance.

In addition, the non-positive orientation of the remote projection(s) renders it more difficult for the bit to be inadvertently ejected from the holder.

Although the invention has been described in accordance with a preferred embodiment thereof, it will be appreciated by those skilled in the art that additions, modifications, substitutions and deletions not specifically described may be made without departing from the spirit and scope of the invention as defined in the appended claims.

What is claimed is:

1. In the combination of a cutter bit and a retainer clip carried by said bit, said bit comprising a forward cutter head, a rearward shank, and a recess on said shank, said clip comprising an annular strip having circumferentially spaced ends defining a gap therebetween, and a plurality of projections projecting outwardly from said strip, said projections being arranged for camming said strip to a radially contracted condition in response to said clip-carrying shank being operable to spring radially outwardly in response to said projections becoming aligned with a retaining groove in said hole, the improvement wherein said projections are arranged to produce radial non-centering movement of said clip relative to said shank in response to forward displacement of said shank in said hole such that said gap approaches the longitudinal axis of said shank.

2. Apparatus according to claim 1, wherein said recess in said shank is bordered at the rear by an abutment portion os said shank which is of larger radius than said recess.

3. Apparatus according to claim 1, wherein said gap is defined by two circumferentially overlapping extensions of said strip.

4. Apparatus according to claim 1, wherein said projection means comprises proximate projection means and remote projection means, said proximate projection means comprising at least two proximate projections located on opposite sides of said gap and said remote projection means comprising at least one remote projection located remotely therefrom, said proximate projection means and remote projection means including front surface means facing generally in the direction of said cutter head, said front surface means of said at least two proximate projections being disposed to contact a front wall of said retaining groove prior to said front surface means of said at least one remote projection in response to forward displacement of said shank within the hole.

5. Apparatus according to claim 4, wherein said front surface means of said at least one remote projection is disposed longitudinally rearwardly relative to said front surface means of said at least two proximate projections.

6. Apparatus according to claim 4, wherein said front surface means of said remote projection is non-positively oriented and arranged to abut against said wall of said groove upon further forward displacement of said shank, the shank being thereafter forwardly displaceable only upon shearing of said remote projection.

7. Apparatus according to claim 4, wherein said front surface means of said remote projection is oriented substantially radially.

8. Apparatus according to claim 4, wherein said front surface means of said remote projection is negatively oriented.

9. Apparatus according to claim 2, wherein said at least one remote projection comprises two remote projections, and said proximate projections are disposed generally diametrically opposite respective ones of said remote projections.

10. Apparatus accoarding to claim 4, wherein said front surface means of said remote projection is disposed longitudinally forwardly of a plane which bisects said proximate projections.

11. Apparatus according to claim 4, wherein said front surface means of said remote projection lies on a plane which bisects said proximate projections.

12. Apparatus according to claim 4, wherein said remote projection is symmetrical about a transverse plane which bisects said remote projection, and said proximate projections are each symmetrical about said plane.

13. Apparatus according to claim 4, wherein said at least two proximate projections comprises a first pair of proximate projections located on opposite sides of said gap and defining said front surface means of said proximate projection means, and a second pair of proximate projections disposed longitudinally rearwardly of said first proximate projections and defining rear surface means of said proximate projection means.

14. Apparatus according to claim 4, wherein longitudinally forwardmost portions of said front surface means of said proximate and remote projection means lie on a common plane extending perpendicular relative to the axia of said shank.

15. In the combination of a cutter bit and a retainer clip carried by said bit, said bit comprising a forward cutter head, a rearward shank, and a recess on said shank, said clip comprising an annular strip mounted in said recess and having circumferentially spaced ends defining a gap therebetween, proximate projection means and remote projection means projecting outwardly from said strip, said proximate projection means including at least two projections located on opposite sides of said gap, and said remote projection means located remotely therefrom and defining positively oriented rear surface means, said proximate surface means defining positively oriented rear surface means and positively oriented front surface means, said rear surface mans of said proximate and remote projection mans camming said strip to a radially contracted condition in response to said clip-carrying shank being rearwardly inserted into a hole of a holder, said contracted strip being operable to spring radially outwardly in response to said proximate and remote projection means becoming aligned with a retaining groove in the hole, the improvement wherein said remote projection means defines front surface means disposed longitudinally rearwardly relative to said front surface means of said proximate projection means such that forward displacement of said shank within the hole produces contact between said front surface means of said proximate projection means and a wall of said retaining groove to produce radial non-centering movement of said clip relative to said shank whereby said gap approaches the longitudinal axis of said shank.

16. In a retainer clip for use with a bit of the type comprising a forward cutter head, a rearward shank, and a recess in the shank for receiving the clip, said clip comprising an annular strip having circumferentially spaced ends defining a gap therebetween, at least a pair of proximate projections and at least one remote projection projecting outwardly from said strip, said proximate projections located on opposite sides of said gap, and said at least one remote projection located remotely therefrom, said proximate projections including positively oriented front surfaces, the improvement wherein said at least one remote projection includes a front surface whose forwardmost portion is disposed longitudinally rearwardly relative to forwardmost portions of said front surfaces of said proximate projections.

17. Apparatus according to claim 16, wherein said proximate and remote projections include positively oriented rear surfaces.

18. Apparatus according to claim 16, wherein said front surface of said at least one remote projection is oriented substantially radially.

19. Apparatus according to claim 16, wherein said front surface of said at least one remote projection is negatively oriented.

20. Apparatus according to claim 16, wherein said at least one remote projection comprises two remote projections disposed generally diametrically opposite respective ones of said proximate projections.

21. Apparatus according to claim 16, wherein said front surface of said at least one remote projection is disposed longitudinally forwardly of a plane which bisects said proximate projections.

22. Apparatus according to claim 16, wherein said front surface of said at least one remote projection lies on a plane which bisects said proximate projections.

23. Apparatus according to claim 16, wherein said remote projection is symmetrical about a transverse plane which bisects said remote projection, and said proximate projections are each symmetrical about said plane.

24. Apparatus according to claim 16, wherein said gap is defined by two circumferentially overlapping extensions of said strip.

25. In a combination of a cutter bit, a bit holder and a retainer clip for securing said bit within said holder, said holder comprising a hole and an annular retaining groove in said hole, said bit comprising a front cutter head, a rear shank disposed in said hole, and an annular recess in said shank, said clip comprising an annular strip disposed in said recess, said strip including spaced ends forming a circumferential gap in said strip, a pair of proximate projections and a pair of remote projections projecting radially from said strip and disposed in said retaining groove, said proximate projections disposed generally diametrically opposite respective ones of said proximate projections, said remote and proximate projections including positively oriented front surfaces facing said cutter head, the improvement wherein said remote projections each include a radially disposed front surface, said radially disposed front surfaces being disposed rearwardly relative to forwardmost portions of said front surfaces of said proximate projections, and forwardly relative to a center plane bisecting said proximate projections such that forward displacement of said shank within said hole produces contact between said front surfaces of said proximate projections and a wall of said retaining groove to produce a radial non-centering movement of said clip whereby said gap approaches the longitudinal axis of said shank.

26. A method of retaining a cutter bit in a holder comprising the steps of:

A. inserting a shank portion of the bit into a hole in said holder such that an annular, radially contractible spring clip on said shank portion is radially contracted in response to contact between said hole and at least two proximate radial projections and at least one remote radial projection of said clip;

B. displacing said shank rearwardly within said hole until said remote and proximate projections become radially aligned with a retaining groove in said hole, whereupon said clip radially expands and said projections enter said groove;

C. abutting said bit against an earth formation to cut the formation in a manner whereby forwardly directed forces are imposed upon said bit to forwardly displace the latter relative to said hole; and D. causing contact between a wall of said groove and positively oriented front surfaces of at least some of said proximate projections in response to such forward displacement of said bit, with a front surface of said remote projection being spaced from said wall, whereupon said clip and its longitudinal axis is shifted radially relative to said shank such that a circumferential gap of said clip disposed between said proximate projections is displaced toward the longitudinal axis of said shank.

27. A method according to claim 26, further including the step of:

E. causing contact between a wall of said groove and a non-positively oriented front surface of said remote projection after said clip has been shifted radially, whereupon further forward displacement of said shank is possible only by shearing said remote projection.

* * * * *